US008827276B2

(12) United States Patent
Kennedy et al.

(10) Patent No.: US 8,827,276 B2
(45) Date of Patent: Sep. 9, 2014

(54) SLIDING MEMBER HAVING A THERMALLY SPRAYED COATING AND METHOD FOR PRODUCING SAME

(75) Inventors: Marcus Kennedy, Dusseldorf (DE); Michael Zinnabold, Burscheid (DE); Marc-Manuel Matz, Friedberg (DE)

(73) Assignee: Federal-Mogul Burscheid GmbH, Burscheid (DE)

( * ) Notice: Subject to any disclaimer, the term of this patent is extended or adjusted under 35 U.S.C. 154(b) by 186 days.

(21) Appl. No.: 13/387,864

(22) PCT Filed: Apr. 15, 2010

(86) PCT No.: PCT/EP2010/054961

§ 371 (c)(1),
(2), (4) Date: Jan. 30, 2012

(87) PCT Pub. No.: WO2011/012336

PCT Pub. Date: Feb. 3, 2011

(65) Prior Publication Data

US 2012/0126487 A1 May 24, 2012

(30) Foreign Application Priority Data

Jul. 29, 2009 (DE) ..... 10 2009 035 210

(51) Int. Cl.
*C23C 4/06* (2006.01)

(52) U.S. Cl.
CPC ..... *C23C 4/06* (2013.01)
USPC ..... 277/442; 277/434; 277/440

(58) Field of Classification Search
USPC ..... 277/434, 440, 442, 443, 444
See application file for complete search history.

(56) References Cited

U.S. PATENT DOCUMENTS

| | | | | |
|---|---|---|---|---|
| 3,971,633 | A | 7/1976 | Wolfla et al. | |
| 5,314,659 | A * | 5/1994 | Hidaka et al. | 420/428 |
| 5,425,822 | A * | 6/1995 | Hidaka et al. | 148/407 |
| 5,747,163 | A | 5/1998 | Douglas | |
| 2007/0084834 | A1 * | 4/2007 | Hanus et al. | 219/121.5 |

FOREIGN PATENT DOCUMENTS

| | | | | |
|---|---|---|---|---|
| DE | 10163933 | A1 | 7/2003 | |
| DE | 10163976 | A1 | 7/2003 | |
| EP | 529208 | A1 * | 3/1993 | C22C 27/06 |
| EP | 0834585 | A1 | 4/1998 | |
| EP | 1564309 | A1 | 8/2005 | |

OTHER PUBLICATIONS

Guilemany J M et al, "Characterisation of Cr3C2—NiCr Cermet Powder for High Velocity Oxyfuel Spraying", Powder Metallurgy, Maney Publishing, London, GB, Bd.37, Nr. 4, 1. Jan. 1994, Seiten 289-292.

* cited by examiner

*Primary Examiner* — Gilbert Lee
(74) *Attorney, Agent, or Firm* — Robert L. Stearns; Dickinson Wright, PLLC

(57) ABSTRACT

A sliding member for an internal combustion engine includes: a substrate and a coating obtainable by thermally spraying a powder, having the element proportions of 55 to 75 wt % of chromium, Cr; 3 to 10 wt % of silicon, Si; 18 to 35 wt % of nickel, Ni; 0.1 to 2 wt % of molybdenum, Mo; 0.1 to 3 wt % of carbon, C; 0.5 to 2 wt % of boron, B; and 0 to 3 wt % of iron, Fe.

8 Claims, 1 Drawing Sheet

Cr-Ni-Si-C-Fe-B coating, produced by HVOF, on piston ring

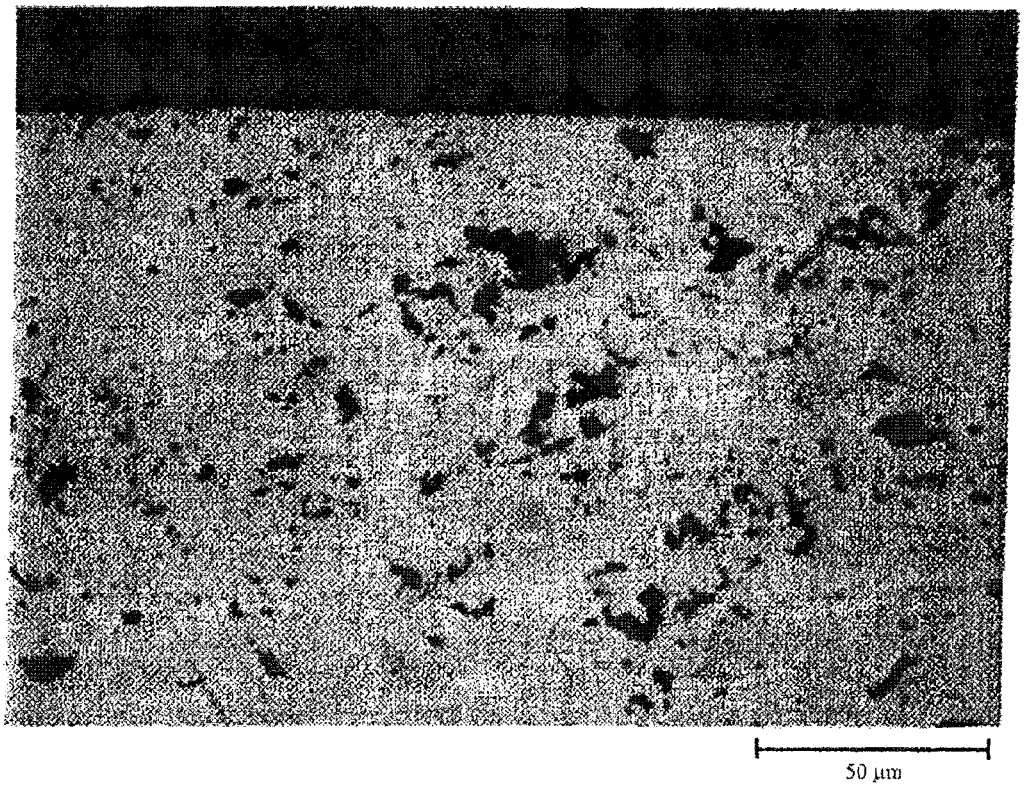
Cr-Ni-Si-C-Fe-B coating, produced by HVOF, on piston ring

SLIDING MEMBER HAVING A THERMALLY SPRAYED COATING AND METHOD FOR PRODUCING SAME

BACKGROUND OF THE INVENTION

1. Technical Field

The present invention relates to a sliding element, particularly a piston ring, for an internal combustion engine, and a method for producing such a sliding member.

2. Related Art

Chromium-based coatings that are applied by thermal spraying are not yet being used on piston rings. At present, chromium-containing coating systems are applied to piston rings via galvanic processes. In addition, metal oxide or diamond particles are embedded in the chromium layers during the process to improve wear resistance.

An alternative to the chromium layers reinforced with metal oxide or diamond particles that are produced via galvanic processes is to coat sliding members with chromium-based materials by thermal spraying. The particles of hard material used for reducing wear in the thermally sprayed layer are chromium carbides ($Cr_3C_2$).

The use of Cr-based coating systems with chromium carbides as a piston ring coating material, produced by plasma spraying or high-velocity oxy fuel (HVOF) thermal spraying, results in the production of a new type of piston ring.

SUMMARY OF THE INVENTION AND ADVANTAGES

The object of the invention is to improve the tribological properties of thermally sprayed piston rings with a previously unused material system as the coating material in comparison with the piston ring coatings that are produced via galvanic methods or thermal spraying.

According to a first aspect of the invention, a sliding member for an internal combustion engine is provided, comprising a substrate and a coating, which is obtainable by thermal spraying of a powder made up of the following element proportions 55-75 percent by weight chromium, Cr;
3-10 percent by weight silicon, Si;
18-35 percent by weight nickel, Ni;
0.1-2 percent by weight molybdenum, Mo;
0.1-3 percent by weight carbon, C;
0.5-2 percent by weight boron, B; and
0-3 percent by weight iron, Fe.

The material used for the sliding member, particularly a piston ring, may be for example steel or cast iron.

According to one embodiment, the powder includes $Cr_3C_2$ embedded in a Ni/Cr matrix.

According to one embodiment, the proportion of $Cr_3C_2$ is adjusted to 30-50 percent by weight $Cr_3C_2$.

According to one embodiment, the particle sizes of the powder are in a range from 5-65 μm.

According to one embodiment, the particle size of carbides embedded in the Ni/Cr matrix is in a range from 1-5 μm.

According to one embodiment, the layer thickness of the coating is up to 1000 μm.

According to one embodiment, the thermal spraying method includes high-velocity oxy fuel spraying or plasma spraying.

According to one embodiment, the sliding member is a piston ring.

According to a further aspect of the invention, a method for producing a sliding member for an internal combustion engine is provided, including providing a substrate and coating the substrate by thermal spraying of a powder that includes the following element proportions:

55-75 percent by weight chromium, Cr;
3-10 percent by weight silicon, Si;
18-35 percent by weight nickel, Ni;
0.1-2 percent by weight molybdenum, Mo;
0.1-3 percent by weight carbon, C;
0.5-2 percent by weight boron, B; and
0-3 percent by weight iron, Fe.

According to one embodiment, the powder includes $Cr_3C_2$ embedded in a Ni/Cr matrix.

According to one embodiment, the proportion of $Cr_3C_2$ is adjusted to 30-50 percent by weight $Cr_3C_2$.

According to one embodiment, the particle sizes of the powder are in a range from 5-65 μm.

According to one embodiment, the particle size of carbides embedded in the Ni/Cr matrix is in a range from 1-5 μm.

According to one embodiment, the layer thickness of the coating is up to 1000 μm.

According to one embodiment, the thermal spraying method includes high-velocity oxy fuel spraying or plasma spraying.

According to one embodiment, the sliding member is a piston ring.

BRIEF DESCRIPTION OF THE DRAWING

FIG. 1 shows an image of the microstructure of Cr—Ni—Si—C—Fe—B coating according to the invention on piston ring material, produced by HVOF.

DETAILED DESCRIPTION

The powder was sprayed and the microstructure (shown in FIG. 1) and hardness as well as wear resistance properties were tested. The microstructure images show homogeneously distributed carbides, no unmelted particles, and a very dense layer with low porosity. The material system used in this case yielded the following chemical composition:

65.5-65.7 percent by weight chromium, Cr;
3.7-3.9 percent by weight silicon, Si;
21.2-21.4 percent by weight nickel, Ni;
1.2-1.3 percent by weight molybdenum, Mo;
5.8-5.9 percent by weight carbon, C;
0.7 percent by weight boron, B; and
1.2 percent by weight iron, Fe;

wherein the proportion of $Cr_3C_2$ is 40 percent by weight.

Initial tests have shown that the layers have a porosity of <5% and a hardness of about 948 HV0.1. This is due to the present of hard material phases such as $Cr_3Si$, $Ni_2Si$, $Fe_3B$ and $Cr_5B_3$ as well as the HVOF process.

In order to test the tribological properties of this system, wear tests were conducted on the internal standard test system in the lubricated condition.

Table 1 shows the evaluation of the measured wear values compared with Cr-based layers produced by galvanising and Mo-based layers produced by thermal spraying. It is clearly shown that the material system described in this invention specification may be used as an alternative to other coating technologies. In addition, significantly shorter coating times may be achieved using the thermal spray method (100 μm/min compared with 1 μm/h for galvanising).

TABLE 1

Evaluation of different coating systems with regard to wear according to standard wear test, relating to maximum axial wear

| | Ring | Liner |
|---|---|---|
| Series layer (Cr-based, galvanised) | (++) | (+) |
| Series layer (Mo-based, thermal spraying | (0) | (+) |
| Development layer (thermal spraying) | (+) | (+) |

The invention claimed is:

1. A piston ring for an internal combustion engine, comprising a substrate; and a coating, obtained by thermal spraying of a powder including the element proportions 55-75 percent by weight chromium, Cr;

3.7-10 percent by weight silicon, Si;

18-35 percent by weight nickel, Ni;

0.1-2 percent by weight molybdenum, Mo;

0.1-3 percent by weight carbon, C;

0.5-2 percent by weight boron, B; and 0-3 percent by weight iron, Fe;

wherein the powder includes $Cr_3C_2$ embedded in a Ni/Cr matrix, the proportion of $Cr_3C_2$ is 30-50 percent by weight, and the particle size of the $Cr_3C_2$ embedded in the Ni/Cr matrix is in a range from 1-5 μm.

2. The piston ring as recited in claim 1, wherein the particle sizes of the powder apart from the $Cr_3C_2$ are in a range from 5-65 μm.

3. The piston ring as recited in claim 1, wherein the layer thickness of the coating is up to 1000 μm.

4. The piston ring as recited in claim 1, wherein the thermal spraying method includes high velocity oxy fuel spraying or plasma spraying.

5. A method for producing a piston ring for an internal combustion engine, including the steps of providing a substrate; and coating the substrate by thermal spraying of a powder including the element proportions 55-75 percent by weight chromium, Cr;

3.7-10 percent by weight silicon, Si;

18-35 percent by weight nickel, Ni;

0.1-2 percent by weight molybdenum, Mo;

0.1-3 percent by weight carbon, C;

0.5-2 percent by weight boron, B; and 0-3 percent by weight iron, Fe;

wherein the powder includes $Cr_3C_2$ embedded in a Ni/Cr matrix, the proportion of $Cr_3C_2$ is 30-50 percent by weight, and the particle size of the $Cr_3C_2$ embedded in the Ni/Cr matrix is in a range from 1-5 μm.

6. The method as recited in claim 5, wherein the particle sizes of the powder apart from the $Cr_3C_2$ are in a range from 5-65 μm.

7. The method as recited in claim 5, wherein the layer thickness of the coating is up to 1000 μm.

8. The method as recited in claim 5, wherein the thermal spraying includes high velocity oxy fuel spraying or plasma spraying.

* * * * *